US008171925B2

(12) United States Patent
Hedberg

(10) Patent No.: US 8,171,925 B2
(45) **Date of Patent: *May 8, 2012**

(54) PAINTBALL LOADER

(75) Inventor: Daniel Hedberg, Varing (SE)

(73) Assignee: Dye Precision, Inc., San Diego, CA (US)

( * ) Notice: Subject to any disclaimer, the term of this patent is extended or adjusted under 35 U.S.C. 154(b) by 13 days.

This patent is subject to a terminal disclaimer.

(21) Appl. No.: 12/497,476

(22) Filed: Jul. 2, 2009

(65) Prior Publication Data

US 2009/0266349 A1 Oct. 29, 2009

Related U.S. Application Data

(63) Continuation of application No. 11/258,100, filed on Oct. 26, 2005, now Pat. No. 7,568,478.

(30) Foreign Application Priority Data

Oct. 26, 2004 (EP) ..... 04025414

(51) Int. Cl.
*F41B 11/02* (2006.01)

(52) U.S. Cl. ..... 124/51.1

(58) Field of Classification Search ..... 124/48, 124/49, 51.1; 221/208, 258, 265, 277; 222/333, 222/410, 411
See application file for complete search history.

(56) References Cited

U.S. PATENT DOCUMENTS 3,589,840 A * 6/1971 Murphy ..... 417/406
3,610,223 A 10/1971 Green
5,097,816 A 3/1992 Miller
5,097,985 A 3/1992 Jones
5,722,383 A 3/1998 Tippmann, Sr. et al.
5,749,797 A 5/1998 Sunseri et al.
5,794,606 A * 8/1998 Deak ..... 124/51.1
5,816,232 A 10/1998 Bell
5,954,042 A 9/1999 Harvey
6,109,252 A 8/2000 Stevens
6,327,953 B1 12/2001 Andresen
6,415,781 B1 7/2002 Perrone
6,502,567 B1 1/2003 Christopher et al.

(Continued)

FOREIGN PATENT DOCUMENTS

DE 199 50 288 4/2001

OTHER PUBLICATIONS

European Search Report dated Apr. 7, 2005, issued in European Patent Application No. 04025414.6.

(Continued)

*Primary Examiner* — John Ricci
(74) *Attorney, Agent, or Firm* — Knobbe Martens Olson & Bear, LLP

(57) ABSTRACT

A paintball loader, more specifically a paintball loader which rapidly and forcibly feeds paintballs to a paintball marker, comprises a rotor body having at least one rotor fin, and a drive motor for rotating the rotor body in a first direction. The paintball loader has a central outlet located radially inwards of the tip of the rotor fin and an abutment body arranged to interact with the at least one rotor fin. When the rotor body is rotated, a paintball, located in a space formed between the at least one rotor fin and the abutment body, is pushed out of the paintball loader through the central outlet.

33 Claims, 4 Drawing Sheets

U.S. PATENT DOCUMENTS

| | | | | |
|---|---|---|---|---|
| 6,526,955 | B1 | 3/2003 | Juan | |
| 6,684,873 | B1 | 2/2004 | Anderson et al. | |
| 6,739,323 | B2 | 5/2004 | Tippmann, Jr. | |
| 7,017,569 | B2 | 3/2006 | Jong | |
| 7,222,617 | B2 | 5/2007 | Andresen | |
| 7,234,456 | B2 | 6/2007 | Andresen | |
| 7,270,121 | B2 * | 9/2007 | Lubben | 124/51.1 |
| 7,275,530 | B2 | 10/2007 | Deak | |
| 7,568,478 | B2 * | 8/2009 | Hedberg | 124/51.1 |
| 7,591,260 | B1 | 9/2009 | Mu | |
| 7,654,255 | B2 | 2/2010 | Spicer | |
| 7,832,389 | B2 | 11/2010 | Christopher | |
| 2002/0059927 | A1 | 5/2002 | Woods | |
| 2002/0092513 | A1 | 7/2002 | Christopher et al. | |
| 2006/0081233 | A1 | 4/2006 | Andresen | |
| 2007/0012304 | A1 * | 1/2007 | van Dorsser et al. | 124/51.1 |
| 2007/0295319 | A1 | 12/2007 | Carter et al. | |
| 2008/0017178 | A1 | 1/2008 | Marques et al. | |
| 2010/0095942 | A1 | 4/2010 | Kaakkola et al. | |

OTHER PUBLICATIONS

European Search Report & Written Opinion, Application No. EP 10 16 4831, dated Sep. 27, 2010, 7 pgs.

Archon Tacamo Gravity Paintball Hopper. Image of paintball hopper on webpage URL:http://paintball-hoppers.com/archon-tacamo-gravity-paintball-hopper/. Retrieval date: May 25, 2010. The Archon Tacamo Gravity Paintball Hopper can be considered prior art for purposes of the present application.

* cited by examiner

PAINTBALL LOADER

CROSS-REFERENCE TO RELATED APPLICATIONS

This application is a continuation of co-pending U.S. patent application Ser. No. 11/258,100, entitled "Paintball Loader," filed on Oct. 26, 2005, which claims priority under 35 U.S.C. §119(a)-(d) to European Patent Application No. 04025414.6, filed on Oct. 26, 2004, all of which are hereby expressly incorporated by reference in their entireties.

TECHNICAL AREA

The present invention relates to a paintball loader, and more specifically to a paintball loader which rapidly and forcibly feeds paintballs to a paintball marker.

TECHNICAL BACKGROUND

Paintball markers (also referred to as paintball guns) are used in war games normally played between two teams of players trying to capture one another's flag. The game is played in a large field with opposing home bases at each end. All of the players have a paintball marker that shoots paintballs, gelatin-covered spherical capsules filled with paint. When the paintball hits a player the capsule is broken and a mark of paint is left on the players clothes, indicating the hit.

Typically, the conventional paintball marker loader includes a housing which is placed on an upper portion of a paintball marker. The housing is shaped to hold a large amount of paintballs. At the bottom of the housing is an outlet tube through which the paintballs drop either by the force of gravity or by the force of a paintball loader mechanism. The outlet tube leads to the marker, where the paintballs are propelled outwardly from the marker by compressed air.

The main reason to provide a feeding mechanism is that the feeding of paintballs only by force of gravity not works satisfactory. Firstly a high rate of fire, which is essential for the player, can not be achieved merely with a gravity driven feeding. Secondly the force of gravity only works when the marker is held in an upright or close to upright position, and consequently there is no feeding at all when the marker is tilted in certain angles since the paintballs then do not fall into the outlet tube.

This problem can be avoided by providing a paintball loader mechanism which by force inputs the paintballs into the outlet tube and into the marker.

Conventional paintball loaders, as the one described in U.S. Pat. No. 6,502,567 generally involve a fin device of circular shape which is driven with a rotational movement provided by a drive motor arranged beneath the housing and with an axle shaft that is upwardly directed and coupled to the rotational centre of the fin device. The paintballs are pushed by the rotation of the fins of the fin device and are consequently pressed forward and outward from the rotational centre by the centrifugal force. The outlet tube is connected to the housing with its input opening located in the outer wall of the housing. It is thus the rotational speed of the drive motor that presses the paintballs into the opening of the outlet tube and into the marker. This paintball feeding arrangement comprising a housing with the opening input of an outlet tube connected to its circumferential wall and a drive motor connected to its bottom wall constitutes a rather bulky arrangement on top of the paintball marker.

An indicator is arranged to detect when the outlet tube is full, and shut off the drive motor. When the player starts firing, the feeding of the paintballs through the outlet tube is initially very slow since only the force of gravity or any pressure between the stuck paintballs causes them to move into the marker. An indicator in the outlet senses that the paintballs are moving, and starts the drive motor again.

However, the rate of balls being forced down the outlet by the rotor is still not satisfactory. Further, the rotor inertia causes a delay before the drive motor reaches its normal speed, thus reducing the rate of paintballs even further in the beginning of a firing burst.

Although a high feeding speed is desirable, the resulting high stresses on the ball may cause problems with breaking paintballs which leads to fluid leakage in the marker or in the paintball loader itself. Such breakages causes problems for, or even a stop of the feeding of the paintballs.

SUMMARY OF THE INVENTION

An object of the present invention is to provide an improved paintball loader which eliminates at least some of the above problems.

According to the present invention this and other objects are achieved with a paintball loader comprising a rotor body having at least one rotor fin and a drive motor for rotating said rotor body in a first direction; an abutment body arranged to interact with said at least one rotor fin, so that, when the rotor body is rotated, a paintball, located in a space formed between said at least one rotor fin and said abutment body, is pushed out of said paintball loader through a central outlet located radially inwards of said space.

The present invention is based on the understanding that an improved feeding of paintballs from a container to a paintball marker can be achieved by delivering the paintballs through a central outlet.

In this way an improved paintball loader having a symmetrical, compact structure that reduces the risk for breakage of the paintballs is achieved.

The central outlet can be located essentially along the rotational axis of the rotor body. By providing the central outlet in this way the paintballs enter the central outlet at a location where the rotational movement of the rotor body is restrained to a turning around it's own longitudinal axis. Consequently, when entering the central outlet, the paintballs are not subjected to any lateral force which might cause them to collide with the inside walls of the central outlet.

Preferably said abutment body is yieldingly arranged in said first direction. By having such a yielding abutment body the abutment body provides a cushioning effect on the paintballs and the risk that the interaction between said at least one rotor fin and said abutment body damages the paintballs is decreased. By arranging the paintball loader according to the invention in this manner, the breakage of paintballs against a fixed abutment body, for example in the case of a jamming of paintballs in the central outlet, can be avoided.

The abutment body can also comprise at least one abutment fin and be arranged to be rotatable coaxially with said rotor. By having such a rotatable abutment body the interaction between said at least one rotor fin and said abutment body can be achieved also by the rotating of the abutment body. An interaction between the rotor fin and the abutment fin moving in opposite directions allows a reduction of the rotor speed and thus reduces the centrifugal force that the paintball is subjected to which in turn reduces the risk for breakage. By providing the abutment body with at least one abutment fin, the abutment body is provided with a part specially adapted to interact with the rotor fin of the rotor body. Such an adaption improves this interaction and facilitates the pushing of paintballs into the central outlet.

Further it is possible to provide that said abutment body is arranged to be driven in a direction opposite said first direction. Thus it is possible to achieve a rate of feeding paintballs to the paintball marker which is higher than what is the case if the paintballs merely would be fed with a motor driven rotor. The moving of both the rotor fin and the abutment fin in opposite directions also reduces the centrifugal force on the paintballs in comparison to if the same effective rotational speed would be achieved by a moving rotor fin towards a fixed abutment fin. In this case it is especially preferred that the abutment body is yieldingly arranged.

According to an embodiment of the invention the paintball loader also comprises a spring member arranged to spring load said abutment body and to rotate it in a direction opposite the rotation of said rotor body. By providing a spring member in this way the abutment body is given a flexible attaching which further reduces the forces on the paintballs thus reducing the risk for breakage. The spring member also provides for that the movement of the paintballs can be stopped in a smooth way. Moreover the paintballs are loaded with a spring loading while waiting to be fed into the marker. The energy loaded in the spring member can be used to further enhance the performance of the paintball loader, for example by providing a rapid starting of the feeding of paintballs after a standstill. This embodiment ensures that a rapid feeding of the paintballs can be achieved when the energy accumulated in the spring member is released. The energy then forces the abutment fin to rotate in the counter-direction of the rotation of the rotor body thereby forcing paintballs out of the paintball loader. Thus it is possible to achieve a rate of feeding paintballs to the paintball marker which is higher than what is the case if the paintballs merely would be fed with a motor driven rotor.

Preferably, said spring member is a leaf spring. By providing a leaf spring the paintball loader has the advantage of subjecting very uniform force to the paintballs, thereby further reducing the risk for ball breakage.

Further, it is possible to provide that said rotor body by the force of said drive motor, when a paintball is prevented to move from said space, is arranged to bring said abutment body to rotate in the same direction as the rotor body. In the case of a spring loaded abutment body energy can be accumulated in the spring member and the accumulated energy can then be used when the feeding of paintballs to the marker continues. The loaded spring will then rotate the abutment body in the opposite direction to the rotation of the rotor, thereby achieving an increased feeding rate to the central outlet in comparison to a feeding with a fixed abutment fin.

Preferably said paintball loader comprises stopping means arranged to stop the drive motor, when the spring member has accumulated a certain amount of energy. By this providing of stopping means the drive motor is stopped first when the spring member is loaded and the drive motor power is thus used for the loading of the spring member.

Preferably said abutment body comprises at least one input opening adjacently before an abutment fin in the sense of the rotational direction of the rotor body, connecting said outlet with said space. By providing the entrance to the central outlet in this manner it is secured that the interaction between the abutment fin and a rotor fin takes place adjacently besides an input opening to the central outlet. This ensures that the paintball easily is pushed into the central outlet. By providing more than one input opening connected to the central outlet it is possible to achieve an increased feeding rate of paintballs into the central outlet. It is also possible to maintain a feeding rate but with a decreased rotational speed of the rotor. Such a decrease reduces the centrifugal forces on the paintballs and thus also the risk for breakage. In order to optimize the performance, the two input openings should be angularly transposed to one another so that paintballs not are pushed into the central outlet through several input openings simultaneously thus causing collisions and breakage of paintballs.

Alternatively, the rotor body can comprise at least one input opening adjacently after a rotor fin in the sense of the rotational direction of the rotor body, connecting said outlet with said space. For this embodiment to have a satisfying performance the rotor body preferably has a smaller number of rotor fins than there are abutment fins.

Thus the input opening or input openings are either provided adjacent a rotor fin or adjacent an abutment fin, whatever less numerous than the other.

Preferably, each rotor fin is arranged to make contact with said paintball on its radially outer half, so that the resulting force of the rotor fin on the paintball has a component directed towards the rotational centre of the rotor body. By having this arrangement paintballs are pushed inwardly and not only forward. It should be noted that a suitable arrangement of the rotor fins can be reached by bending the rotor fin in a forward direction or by attaching each rotor fin to the rotor body with an offset to the rotational centre of the rotor body, so that each rotor fin extends forwardly in the sense of the rotation of the rotor body.

BRIEF DESCRIPTION OF THE DRAWINGS

The present invention will now be described in more detail with reference to the following drawings which show preferred embodiments of the invention and in which.

DETAILED DESCRIPTION OF THE INVENTION

Figure 1:
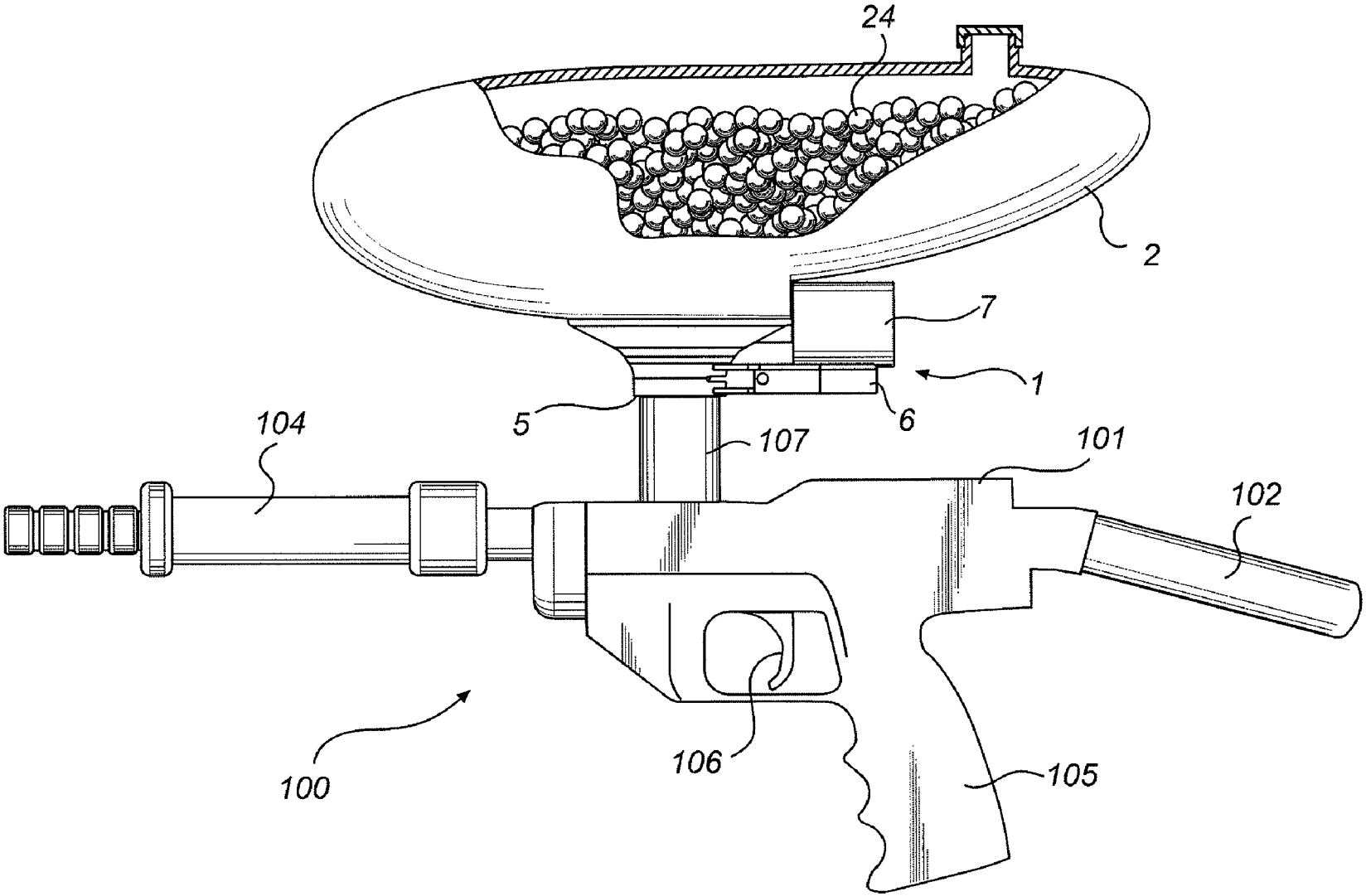
FIG. 1 is a schematic side view of a paintball loader according to an embodiment of the invention, which paintball loader is attached to the top side of a representative paintball marker.

FIG. 1 is a schematic side view of a paintball marker 100 equipped with a paintball loader 1 according to an embodiment of the invention. The paintball loader 1 is attached to the lower part of a paintball container 2, and has a central outlet 5 leading out of the container 2.

The paintball loader 1 is attached to the top side of the paintball marker 100, which is illustrated as an example only. The paintball marker 100 includes a marker body 101 and a compressed gas cylinder 102 which typically is arranged to the rear end of the paintball marker 100. The paintball marker 100 further comprises a barrel 104 and a handgrip 105. The paintball marker 100 also comprises a trigger 106 and an inlet tube 107 which is connected to the central outlet 5 of the paintball loader 1. The inlet tube 107 receives paintballs from the paintball loader 1 and leads to a firing chamber in the interior of the marker body 101.

Figure 2:
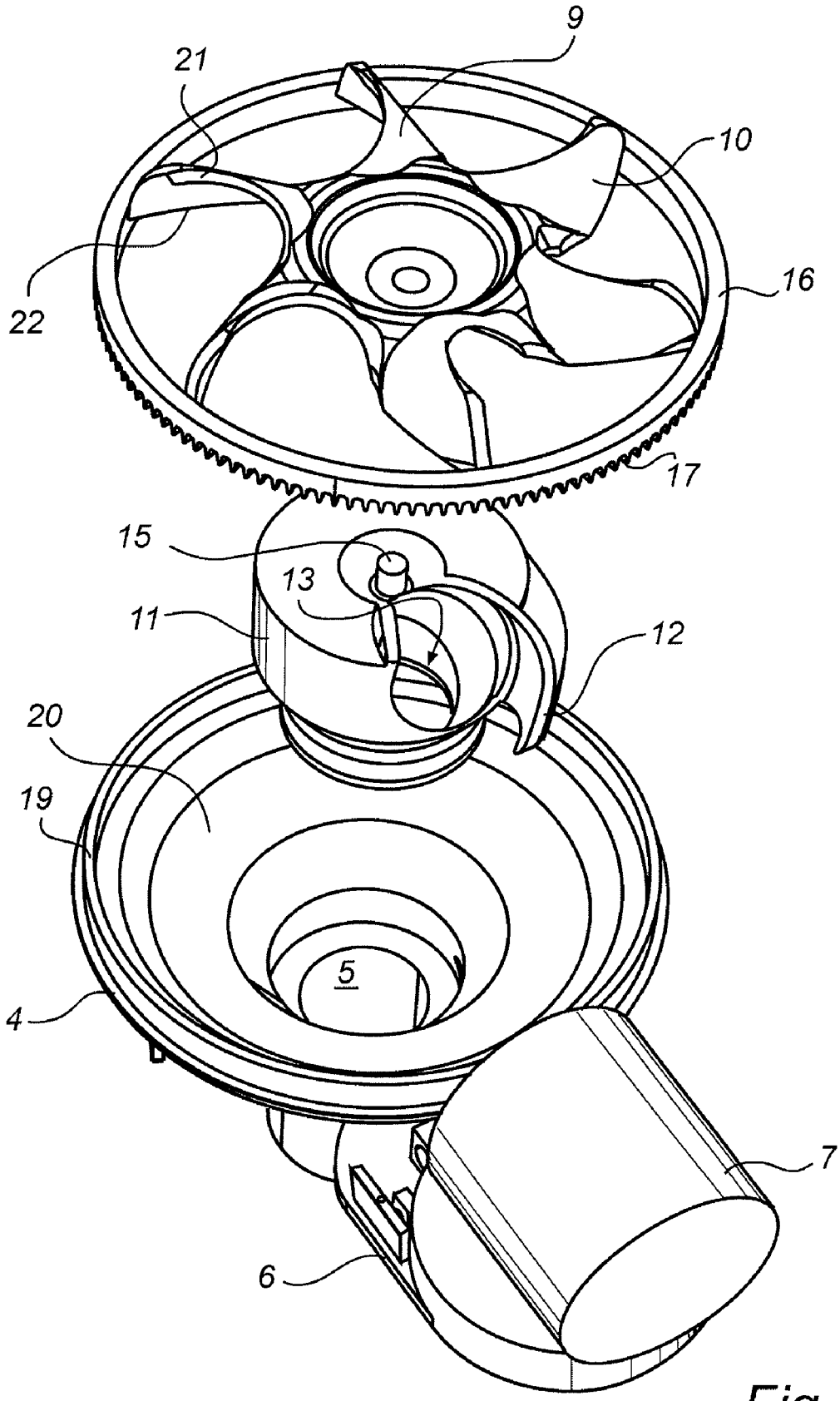
FIG. 2 is an exploded schematic perspective view of a paintball loader according to an embodiment of the invention.

FIG. 2 is an exploded schematic perspective view of a paintball loader of FIG. 1. The loader has a base part 4, adapted to act as a lower limitation of the container 2. The base part 4 is enclosed by a rim 19, and has a bottom surface 20 sloping inwardly towards the centrally located outlet 5.

Figure 4:
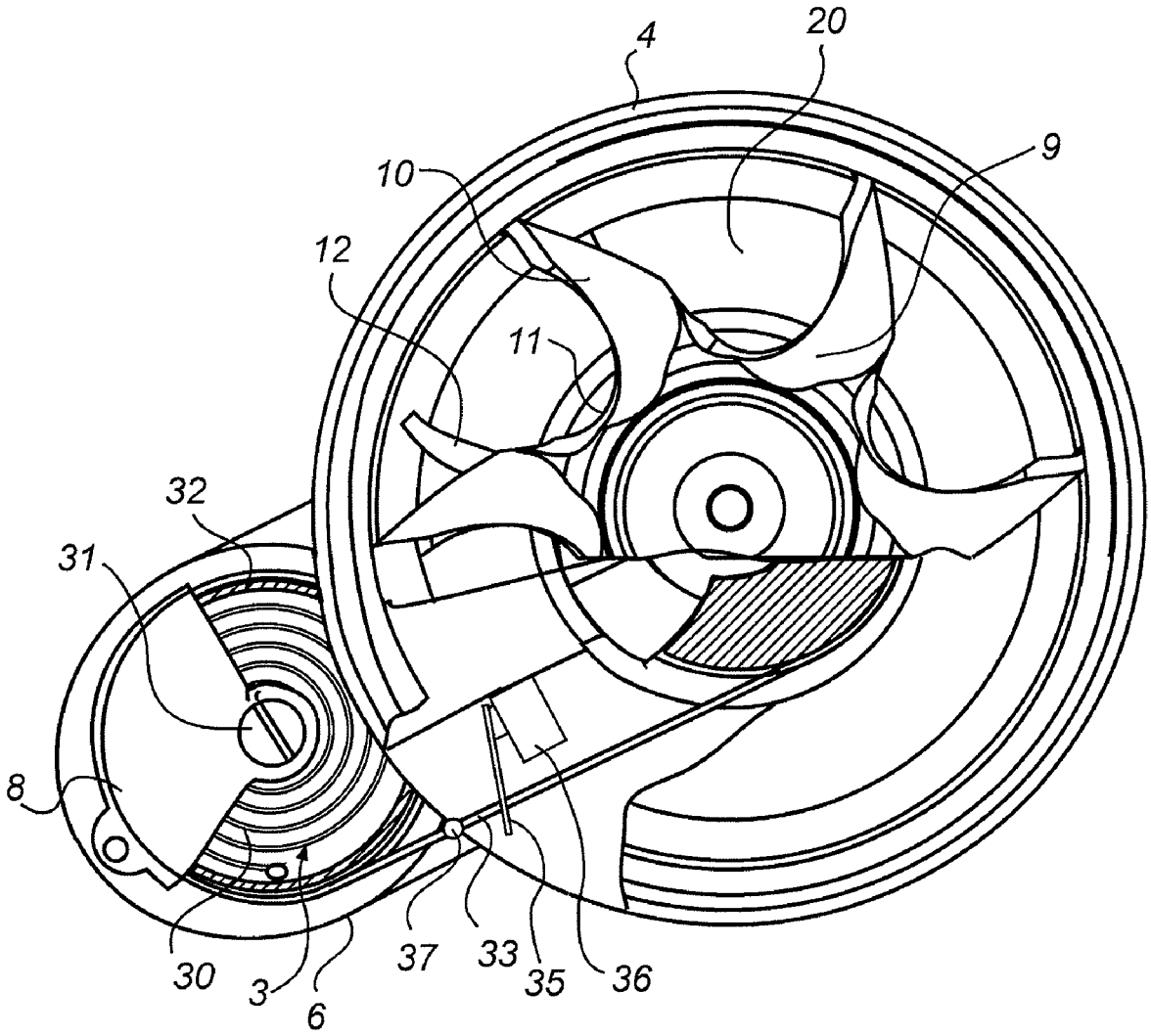
FIG. 4 is a schematic top view of the paintball loader in FIG. 2.

The base part 4 is connected to a control part 6 adapted to support a drive motor 7 and a spring holder 8 (shown in FIG. 4) containing a spring member 3 (also shown in FIG. 4). A transmission wheel (not shown) is connected to the shaft of the drive motor, and protrudes through an opening in the base part 4. By arranging the drive motor and spring holder separately from the container, access and maintenance of these components is facilitated. Moreover these parts are kept away from the paintballs which minimizes the risk for subjecting them to the fluid inside the balls.

An abutment body 11 is rotatably arranged in the base part 4, making contact with the base part 4 along its outside. For example, the abutment body 11 is adapted to be snap fitted into a flange formed in the base part 4. The abutment body 11 is provided with an abutment fin 12 having rounded shape in order to facilitate the pushing of paintballs towards the rotational axis of the abutment body 11. Further, the abutment body 11 has an input opening 13 extending through the rotational axis and communicating with the outlet 5.

On top of the abutment body a rotor body 9 is rotatably arranged. For example, a pin 15 projects along the rotational axis of the abutment body 11, and the centre of the rotor body 9 is provided with a small hole, which is adapted to receive the pin 15. Preferably, a plain bearing is also arranged to reduce any friction.

The rotor body has a plurality of, in the illustrated case six, rotor fins 10, and an outer perimeter 16, which surrounds and connects to the tips of the rotor fins 10. Each rotor fin 10 is adapted push a paintball in a circular motion along the perimeter 16. The radius of the rotor body 9 including the rotor fins 10 determines the number of paintballs possible to push forward simultaneously, and also the distance between each paintball and the rotational axis.

The rotor fins 10 can be ridged, made of e.g. plastic, or be flexible to some extent, made of e.g. rubber. The rotor fins may also be formed by brushes or the like, in particular in a case where the abutment body is fixedly arranged.

In the illustrated embodiment the rotor fins 10 have a rounded shape with the rotor tips being curved in the direction of the rotation. The rotor fins are also projected upwardly from the center of the rotor body 9. In this way an interaction between the rotor fins 10 and the sloping bottom 20 is achieved that forces a paintball inwardly and downwardly towards the axis of rotation.

This forcing inwardly and downwardly is further enhanced by an inclination of the rotor fins 10 in a forward direction in the sense of the rotation, with the upper edge 21 of each rotor fin 10 being located in a more advanced position than the lower edge 22. In this way the rotor fins 10 have a forward inclination which in a preferred embodiment of the invention constitutes an angle of approximately 25 degrees in relation to the rotational plane of the rotor 9.

The rotor fins 10 in FIG. 2 are further formed to make contact with a paintball on its radially outer half, i.e. on the half facing away from the rotational centre of the rotor body 9. Thereby, the resulting force of the rotor fin on the paintball has a component directed radially inwards, i.e. towards the rotational centre of the rotor body 9.

The perimeter 16 is on its underside provided with drive teeth 17 which, in assembled state, engage the transmission wheel. By transmitting the power of the drive motor 7 in this way a reliable operation is achievable. Of course, the drive teeth can be arranged differently on the rotor body, and can for example extend radially from the rotor body, like a conventional cog wheel. Moreover, other transmission techniques may be used.

Figure 3:
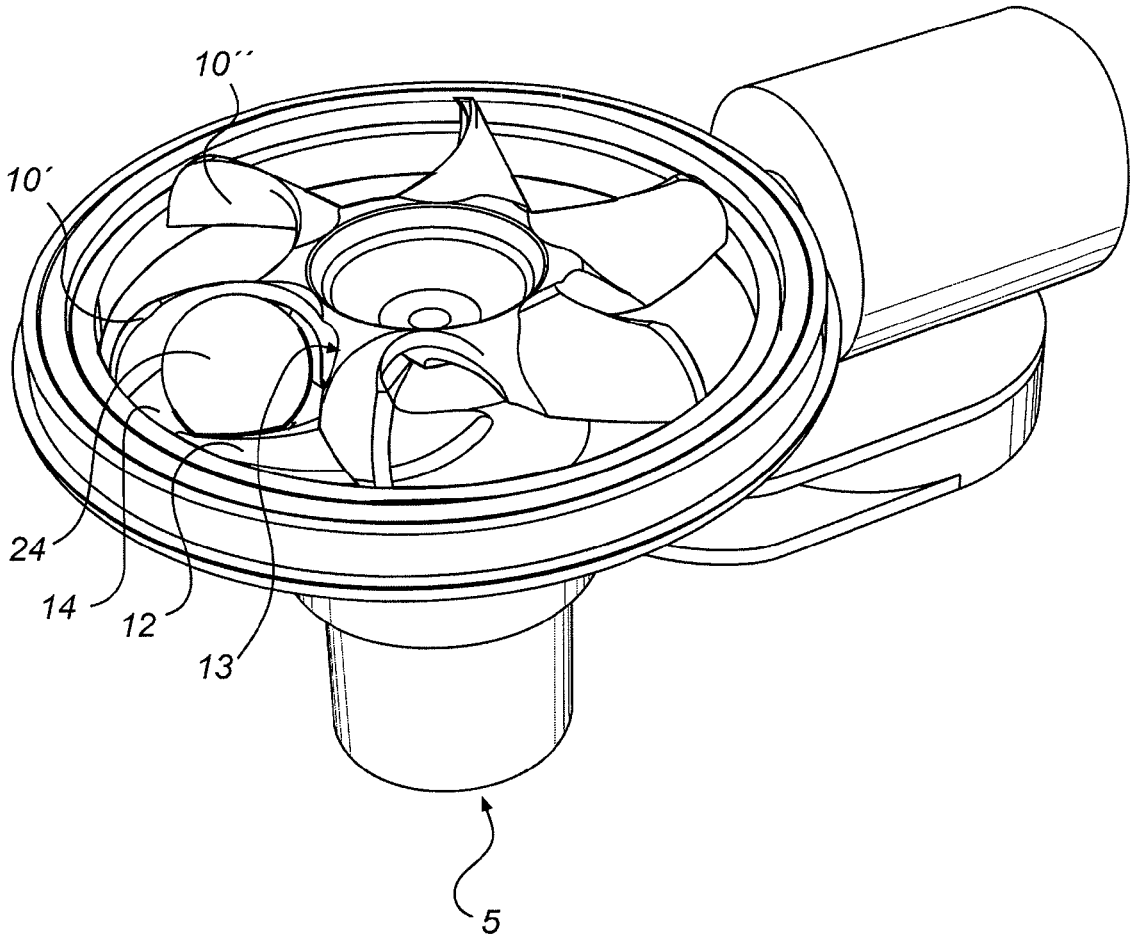
FIG. 3 is a schematic perspective view of the paintball loader in FIG. 2.

FIG. 3 is a schematic perspective view of the assembled paintball loader 1 of FIG. 2. The figure shows how a paintball 24 is located in a space 14 formed between one of the rotor fins 10' and the abutment fin 12, and that the input opening 13 is located so as to connect this space 14 with the outlet 5.

FIG. 4 is a schematic top view of the assembled paintball loader 1 of FIGS. 2 and 3, partly cut away. FIG. 4 shows the rotor body 9 on top of the abutment body 11 in the container 2. Further FIG. 4 illustrates the control part 6 with the drive motor 7 and the spring holder 8 containing the spring member 3, here comprising a leaf spring 30 attached in one end to a fix axis 31 in the spring holder 8, and in the other end to the inside of a cylinder 32 surrounding the spring 30. The cylinder is rotatably arranged in the spring holder 8.

A wire 33 is connected with one end to the outside of cylinder 32, and with the other end to the abutment body 11, so that, when the abutment body is rotated, the wire 33 is wound up on it, to thereby rotate the cylinder 32, loading the spring 30. The wire 33 further extends through a small hole 34 (not shown) in a transfer actuator 35 which is arranged between the abutment body 11 and the spring member 3. The wire 33 is provided with a knot or a thickening 37 between the spring member 3 and the hole 34. The transfer actuator 35 is connected to a drive motor switch 36 fixedly arranged in relation to the control part 6. The transfer actuator 35 and the drive motor switch 36 constitutes a stopping means.

Referring to FIG. 1-4, the operation of the paintball loader 1 will now be explained. The loader 1 is connected to the marker 100 by attaching the central outlet 5 to the inlet tube 107 with an attaching device such as a clamp (not shown).

The majority of the paintballs 24 in the container 2 now rest on top of the rotor body 9 and rotor fins 10, while a few of the paintballs drop down into the compartments formed between the rotor fins 10. The rotor body 9 is rotated by the drive motor 7, via the transmission wheel and drive teeth 17, and a space 14 big enough for containing a paintball 24 is formed between the abutment fin 12 and one of the rotor fins 10'. The interaction between the abutment fin 12 and a rotor fin 10 of the rotor body 9, by movement of one or both fins towards the other fin, pushes the paintballs from the space 14 into the input opening 13 and the central outlet 5. The abutment fin 12 has an angular projecting from the abutment body which ensures that the paintball 24 is pushed into the input opening. After the paintball 24 has entered into the input opening 13, another space 14 forms between the abutment fin 13 and the next rotor fin 10", and another paintball, located in an adjacent compartment is sequentially grasped by the abutment fin 12 and pushed into the central outlet 5 through the input opening 13. Additional paintballs located in the container 2 are drawn downwardly by gravity and fill the vacated compartments.

With the assistance of gravity and the pressure between the balls in the central outlet 5, the paintballs pass through central outlet 5 and reach the inlet tube 107 of the paintball marker 100.

When the inlet tube 107 and central outlet 5 are filled with balls, no more paintballs can be pushed into the outlet 5. As the drive motor continues to drive the rotor body 9, a ball will then be clamped between a rotor fin 10 and the abutment fin 12, and will press the abutment fin 12 in the rotational direction of the rotor body 9. This movement is transferred to the loading of the spring member 3, via the wire 33 that is winded onto the abutment body 11. The force of the spring member 3 can be adjusted, thereby adjusting the pressure between the paintballs and securing that no paintballs are broken because of the force of the spring member.

When the wire 33 is almost completely wound up on the abutment body 11 (typically after around five turns of the abutment body 11), the knot 37 of the wire 33 reaches the transfer actuator 35. Since the hole 34 of the transfer actuator 35 is too small to allow the knot 37 to pass through it, the knot 37 forces the transfer actuator 35 to operate the switch 36 and turn off the drive motor 7.

When a user of the paintball marker 100 wishes to shoot paintballs, the trigger 106 is squeezed, which actuates the compressed gas cylinder 102 to release bursts of compressed gas, thereby shooting paintballs entering the paintball marker through inlet 107.

As paintballs leave the inlet 107, further paintballs will be pushed into the outlet 5 by the spring loaded abutment means. The accumulated energy in the spring member 3 is thus released, and as more balls are pushed into the outlet the abutment fin 11 is forced to rotate in the counter-direction of the rotational direction of the rotor body 9. As the spring action is an immediate mechanical action, activated as soon as the paintballs in the inlet 107 start to move, paintballs will promptly be supplied to the marker as soon as firing commences.

Further, as soon as the spring member 3 starts to rotate, the position of the wire attachment to the cylinder 32 is again moved, and the switch 36 is operated to turn on the drive motor 7. For a while, the rotor 9 and the abutment body 11 are rotated in opposite directions, cooperating to quickly force balls out of the container 2 and through the inlet 107. This decreases the centripetal force having effect upon the paintballs and the risk for breakage is reduced.

When the user ceases fire, paintballs are again prevented from moving through the outlet 5, and the rotor 9 will again start to move the abutment body 11 in its counter direction. When the spring member 3 is loaded, the drive motor will stop.

Alternatively, in case of a long burst, when the spring member has released all its energy, the abutment body 11 comes to a standstill. The rotor body 9 will then continue to rotate, and push paintballs out through the outlet 5 as described above.

While FIG. 2 and FIG. 3 illustrate a preferred embodiment of the invention, also other embodiments are feasible within the scope of the claims of the invention.

For example, while in the shown embodiment the upper rotating body is the rotor, and the lower rotating body is the abutment, this relationship can be reversed. Also, the abutment body is not necessarily rotatable, regardless of if it located on top of or below the rotor. Thus, the claims are intended to cover also an embodiment where a rotating body with at least one fin is arranged beneath a fixed body with at least one abutment fin. The claims are also intended to cover an embodiment where a rotating body with at least one fin is arranged on top of a fixed abutment body, such as a suitably formed ridge in the base part 4.

Further, the abutment body 11 can be provided with several abutment fins 12 which each, in the sense of the rotation, is arranged adjacently behind an input opening 13. Such an embodiment allows a faster forcing of paintballs down the central outlet 5. Preferably the input openings 13 and abutment fins 12 are distributed around the abutment body 11 so that two pairs of an abutment fin 12 and a rotor fin 10 not are allowed to interact simultaneously and press two paintballs into the central outlet 5 at the same time. In this way jamming of paintballs in the central outlet and possible breakage of the paintballs can be avoided.

It is also possible to arrange a separate drive motor for rotating the abutment body. The original drive motor could in such an embodiment lack stopping means making it constantly rotate the rotor body, as long as the paintball marker is turned on, while the abutment body could be driven in the opposite direction. This would minimize the centrifugal force that the paintballs are subjected to. Possibly the arrangement with the spring member would in such an embodiment need to allow the rotation of the abutment body also after that the spring member has reached its full load and in that case there would most likely not be any need of stopping means. It is also possible to have an arrangement with two separate drive motors driving the rotor body 9 and the abutment body 11, respectively, in opposite directions. In this case the spring member 3 may not be required, although this is still preferred.

It should be understood that a number of modifications of the above described embodiment of the invention is possible within the scope of the invention according to the following claims. For example, also use of different types of springs, such as coil springs or cup springs, are within the scope of the invention.

The stopping means can further be designed in a number of different ways. For instance, instead of the transfer actuator 35 operated by the wire 33, the spring holder 8 can be arranged slideably in the control part 6, so that it is movable towards the abutment body 11 when the wire is completely wound up. The holder 8 can then be connected to the drive motor switch, so that such movement turns the drive motor off.

As a further alternative, the drive motor 7 can be torque limited, i.e. designed to shut off as soon as the applied torque exceeds a given threshold. Such a drive motor would only run as long as the paintballs are pushed through the outlet 5, or the abutment body 11 rotates with the rotor 9. As soon as the spring is loaded, and the rotor is prevented to move any further, the torque will increase and the drive motor stop. This embodiment may actually be preferred, as it does not rely on any intermediate elements to turn off the drive motor. As soon as there is a risk of damaging a paintball (increased torque), the drive motor turns off. However, such a torque limited drive motor is of course more expensive.

Finally, another feasible embodiment of the invention is a paintball loader wherein the rotor body comprises the bottom of the container. By having such an embodiment, the number of structural components can be decreased since no separate bottom of the container is needed.

What is claimed is:

1. A paintball loader comprising:

a first member configured to rotate in a first direction and define at least a portion of a space, wherein said first member is a fin; and a second member configured to rotate in a direction opposite said first direction and define another portion of said space, wherein said second member is an abutment.

2. The paintball loader according to claim 1, wherein said space is configured to receive a paintball.

3. The paintball loader according to claim 1 further comprising a drive motor for rotating one of said first member and said second member.

4. The paintball loader according to claim 1 further comprising a rotor body, said first member being at least a portion of said rotor body.

5. The paintball loader according to claim 1, wherein said first member rotates coaxially with said second member.

6. The paintball loader according to claim 1 further comprising an outlet located radially inwards of said space.

7. The paintball loader according to claim 6, wherein said outlet is centrally located.

8. A paintball loader comprising:

a rotor body rotating in a first direction;

an abutment body rotating in a direction opposite said first direction; and a spring member arranged to load one of said abutment body and said rotor body.

9. The paintball loader according to claim 8 further comprising a central outlet.

10. The paintball loader according to claim 8, wherein said rotor body rotates coaxially with said abutment body.

11. The paintball loader according to claim 8 further comprising a drive motor configured to rotate said rotor body.

12. A paintball loader comprising:

a housing;

a first member disposed in said housing and configured to move from a first position toward a second position during a first time frame; and a second member disposed in said housing and configured to move from said second position toward said first position during said first time frame, said first member and said second member simultaneously contacting a paintball during at least a portion of said first time frame.

13. The paintball loader according to claim 12, wherein said first member and said second member rotate about a common axis.

14. The paintball loader according to claim 12, wherein said first member and said second member rotate in opposite directions.

15. The paintball loader according to claim 12, wherein said first member and said second member each define a portion of a space, said space being configured to receive at least a portion of said paintball.

16. The paintball loader according to claim 15, wherein a shape of said space changes as said first member moves toward said second position and said second member moves toward said first position.

17. A paintball loader comprising:

a rotor body having at least one fin;

a drive motor for rotating said rotor body in a first direction; and an abutment body arranged to interact with said at least one fin so that when the rotor body is rotated, a paintball located in a space formed between said at least one fin and said abutment body exits said paintball loader through a central outlet located radially inwards of said space.

18. The paintball loader according to claim 17, wherein said central outlet is disposed along a rotational axis of the rotor body.

19. The paintball loader according to claim 17, wherein said abutment body comprises at least one fin and is arranged to be rotatable coaxially with said rotor body.

20. The paintball loader according to claim 17, wherein said abutment body is arranged to be driven in a direction opposite said first direction.

21. The paintball loader according to claim 17, wherein each fin of said rotor body is arranged to make contact with said paintball on its radially outer half so that the resulting force of the fin on the paintball has a component directed towards a rotational center of the rotor body.

22. The paintball loader according to claim 17 further comprising a spring arranged to load said abutment body.

23. The paintball loader according to claim 22 further comprising stopping means arranged to inhibit rotation of the drive motor when said spring has accumulated a certain amount of energy.

24. A paintball loader comprising:

a first member configured to rotate in a first direction and define at least a portion of a space; and a second member configured to rotate in a direction opposite said first direction and define another portion of said space, wherein said first member rotates coaxially with said second member, and wherein said second member is an abutment.

25. The paintball loader according to claim 24, wherein said space is configured to receive a paintball.

26. The paintball loader according to claim 24 further comprising a drive motor for rotating one of said first member and said second member.

27. The paintball loader according to claim 24 further comprising a rotor body, said first member being at least a portion of said rotor body.

28. The paintball loader according to claim 24, wherein said first member is a fin.

29. The paintball loader according to claim 24 further comprising an outlet located radially inwards of said space.

30. A paintball loader comprising:

a first member configured to rotate in a first direction and define at least a portion of a space, wherein said first member is a fin;

a second member configured to rotate in a direction opposite said first direction and define another portion of said space; and a drive motor for rotating one of said first member and said second member.

31. A paintball loader comprising:

a first member configured to rotate in a first direction and define at least a portion of a space, wherein said first member is a fin;

a second member configured to rotate in a direction opposite said first direction and define another portion of said space; and an outlet located radially inwards of said space.

32. A paintball loader comprising:

a first member configured to rotate in a first direction and define at least a portion of a space;

a second member configured to rotate in a direction opposite said first direction and define another portion of said space, wherein said first member rotates coaxially with said second member; and a drive motor for rotating one of said first member and said second member.

33. A paintball loader comprising:

a first member configured to rotate in a first direction and define at least a portion of a space;

a second member configured to rotate in a direction opposite said first direction and define another portion of said space, wherein said first member rotates coaxially with said second member; and an outlet located radially inwards of said space.

* * * * *